US005730205A

United States Patent [19]

Thomas et al.

[11] Patent Number: 5,730,205

[45] Date of Patent: Mar. 24, 1998

[54] DIE ASSEMBLY FOR SQUEEZE CASTING

[76] Inventors: Robert Anthony Thomas, 37099 Deer Run, Solon, Ohio 44139; James B. Thomas, 7945 Country La., Bainbridge, Ohio 44023

[21] Appl. No.: 679,850

[22] Filed: Jul. 15, 1996

[51] Int. Cl.[6] ..... B22D 17/12

[52] U.S. Cl. ..... 164/319; 164/341; 164/342

[58] Field of Search ..... 164/319, 341, 164/342, 120, 136, 137

[56] References Cited

U.S. PATENT DOCUMENTS

| | | |
|---|---|---|
| 1,450,648 | 4/1923 | Schwartz . |
| 2,371,456 | 3/1945 | McGill . |
| 2,967,339 | 1/1961 | Ma et al. . |
| 3,068,539 | 12/1962 | Wilcoxon . |
| 3,120,038 | 2/1964 | Lauth . |
| 3,802,063 | 4/1974 | O'Connor . |
| 3,802,483 | 4/1974 | Killion et al. . |
| 3,903,951 | 9/1975 | Kaneko et al. . |
| 3,945,428 | 3/1976 | Yanagisawa et al. . |
| 4,049,040 | 9/1977 | Lynch . |
| 4,049,041 | 9/1977 | Nikolov et al. . |
| 4,113,473 | 9/1978 | Gauvry et al. . |
| 4,354,545 | 10/1982 | Goldhammer . |
| 4,497,359 | 2/1985 | Suzuki et al. . |
| 4,519,437 | 5/1985 | Logvinov et al. . |
| 4,570,693 | 2/1986 | Barlow . |
| 4,592,405 | 6/1986 | Allen . |
| 4,760,874 | 8/1988 | Mihara . |
| 4,779,666 | 10/1988 | Ruhlandt et al. . |
| 4,786,340 | 11/1988 | Ogawa et al. . |
| 4,799,531 | 1/1989 | Yamamoto et al. . |
| 4,817,700 | 4/1989 | Milov et al. . |
| 4,932,458 | 6/1990 | Iwamoto et al. . |
| 4,966,223 | 10/1990 | Mihara . |
| 4,967,826 | 11/1990 | Kopp et al. . |
| 5,067,550 | 11/1991 | Maekawa et al. . |
| 5,183,096 | 2/1993 | Cook . |
| 5,207,263 | 5/1993 | Maier et al. . |
| 5,207,264 | 5/1993 | You . |
| 5,211,216 | 5/1993 | Drury et al. . |
| 5,263,531 | 11/1993 | Drury et al. . |
| 5,311,918 | 5/1994 | Scott . |
| 5,320,157 | 6/1994 | Siak et al. . |
| 5,343,927 | 9/1994 | Ivansson . |
| 5,355,933 | 10/1994 | Voss . |
| 5,394,930 | 3/1995 | Kennerknecht . |
| 5,415,464 | 5/1995 | Scott . |
| 5,427,170 | 6/1995 | Arakawa et al. . |
| 5,433,262 | 7/1995 | Kawaguchi et al. . |
| 5,433,300 | 7/1995 | Barlow et al. . |
| 5,478,219 | 12/1995 | Nardon et al. . |
| 5,605,187 | 2/1997 | Perrella et al. ..... 164/342 |

FOREIGN PATENT DOCUMENTS

| | | |
|---|---|---|
| 5668575 | 6/1981 | Japan . |
| 1104454 | 4/1989 | Japan . |
| 2175065 | 7/1990 | Japan . |
| 821052 | 4/1981 | U.S.S.R. . |
| 9513 | 6/1915 | United Kingdom . |
| 2104810 | 8/1981 | United Kingdom . |
| 2196986 | 5/1988 | United Kingdom . |

*Primary Examiner*—Joseph J. Hail, III
*Assistant Examiner*—I.-H. Lin

[57] ABSTRACT

A die assembly for squeeze casting an article includes a two-piece first die section including a densifying die member and a base die member and a second die section. The first and second die sections define a die cavity therebetween having the shape of an article to be cast. The die sections are movable between an open position and a closed position in which the die cavity can be filled with an accurately controlled volume of molten material. The densifying die member is movable relative to the base die member from a first position to a densifying position in which the densifying die member is spaced apart from the base die member to accurately reduce the volume of the die cavity when the first and second die sections are in their closed position and the die cavity is filled with molten material.

25 Claims, 4 Drawing Sheets

DIE ASSEMBLY FOR SQUEEZE CASTING

DESCRIPTION—TECHNICAL FIELD

The present invention relates to a die assembly for squeeze casting an article from a molten material such as aluminum, including a two-piece first die section including a densifying die member and a base die member, and a second die section. A die cavity is defined by the first and second die sections. The densifying die member is operable to move from a first position or fill position for the die cavity in which the densifying member is contiguous to the base die member to a densifying position in which the densifying die member is moved away from the base die member toward the second die section to reduce the volume of the die cavity to squeeze cast an article.

BACKGROUND OF THE INVENTION

Squeeze casting apparatus is well known in the prior art as exemplified by U.S. Pat. Nos. 5,433,262, 3,802,063 and 5,343,927. The known prior art utilizes complicated die assemblies which are impractical to build and maintain under the high operating temperatures associated with the die assemblies. In addition, other prior art discloses die assemblies in which it is difficult to maintain precise registration between the male and female die members when the die members are in their closed position and define a die cavity to be filled with a molten metallic material and when the die members are in their densifying position in which either the die cavity is generally reduced in volume or a pressurizing device is utilized to pressurize the molten metallic material in the die cavity. In addition, the known prior art suffers from the disadvantage that it is difficult to quickly remove and replace die assemblies from the squeeze casting machine while still maintaining precise registration between the newly inserted die assemblies when the die assemblies are moved to their closed position and to their densifying position.

One known squeeze casting method includes a plunger which extends into a central region of the mold cavity to densify the metal proximate to the plunger. The pressure from the plunger compresses the molten metal to densify the material. The known squeeze casting devices, such as those that utilize a central plunger, effect greater densification of the metallic material proximate the plunger than material which is spaced apart from the plunger. This results in uneven density and metallurgic properties in the cast article.

Other known squeeze casting apparatus, such as disclosed in U.S. Pat. No. 5,433,262, utilize a die having a die insert which is slidable within the die to reduce the volume of its die cavity by an amount corresponding to the volume shrinkage of the molten metal within the die. Such a construction results in tooling that is costly, complex, difficult to maintain, and results in leakage of molten metal between the die and the die insert, which creates flashing and causes maintenance problems which require disassembly. Additionally, the die construction results in directional solidification of the molten metal in which solidification occurs progressively from the small dimensioned gate outwardly. Directional solidification may result in uneven metallurgical properties of the final cast article.

Other known squeeze casting apparatus such as disclosed in U.S.S.R. Patent 821,052 also use die or mold members which slide within other members to reduce the volume of the die cavity. The use of a die or die insert which slides within another member is undesirable in squeeze casting where the high pressures tend to push molten metal between the sliding die members which results in maintenance problems and a decrease in accuracy due to the flow of molten metal between the sliding die inserts.

The present invention overcomes the disadvantages associated with the prior art by providing a simplified die assembly for squeeze casting an article, which includes a two-piece first die section, including a densifying die member and a base die member and a second die section, and wherein the relative movement of the first and second die section is accurately controlled to thereby accurately control the volume of the die cavity when in its filled and densifying positions. The densifying die member does not slide within the base die member or the second die section and is adapted to move from a position in which the densifying die member and base die member are disposed contiguous to each other to a position in which the densifying die member and base die member are spaced apart from each other. Such a construction eliminates the flow of molten metal between the base and densifying die members and the resultant maintenance problems. The die sections can be readily removed and replaced from the squeeze casting machine in a minimum amount of time while still maintaining precise registry between the newly inserted die sections when in their fill and densifying positions. In addition, the densifying die member is operable to apply pressure to the article to be cast in the die cavity across substantially the entire face of the die cavity to improve the uniformity of the metallic structure of the cast article over those articles cast where the pressure for squeeze casting is not uniformly applied but is applied to a localized section of the article to be cast.

SUMMARY OF THE INVENTION

The present invention provides a new and improved die assembly for squeeze casting an article from a molten metallic material, including a two-piece first die section including a densifying die member and a base die member, and a second die section. The first die section is secured to a platten of a squeeze casting machine, and the second die section is adapted to be secured to a second platten of a squeeze casting machine. The die sections cooperate to define a die cavity having the shape of an article to be cast and are movable relative to each other from an open position in which the first die section is spaced apart from the second die section, and a closed position in which the first die section is disposed contiguous to the second die section to define a die cavity therebetween. The densifying die member of the first die section cooperates with the second die section to define the die cavity and is movable relative to the base die member from a first position to a densifying position in which the densifying member is spaced apart from the base die member. The densifying member, when moving to the densifying position, reduces, by an accurately controlled predetermined amount, the volume of the die cavity.

Another provision of the present invention is to provide a die assembly as set forth in the previous paragraph, further including a stop surface disposed on the second die section for engaging with the densifying die member of the first die section to accurately locate the second die section relative to the densifying die member when the densifying die member moves to the densifying position to accurately control the volume of the die cavity.

Still another provision of the present invention is to provide a new and improved die assembly for squeeze casting an article including a two-piece first die section including a densifying die member and a base die member, and a second die section, the first and second die sections cooperating to form a die cavity therebetween in the shape of an article to be cast and being movable between an open position in which the first die section is spaced apart from the second die section, and a closed position in which the first and second die sections are disposed contiguous to each other to define a fill position for the die cavity wherein the die cavity can be filled with an accurately controlled volume of molten material. A plurality of elongate guide members extend from the base die member toward the second die section, and the densifying die member has a plurality of openings, each of which is adapted to receive one of the guide members therein for supporting the densifying die member from movement relative to the base die member from a first position in which the densifying member is disposed contiguous to the second die section to define the fill position for the die cavity to a densifying position in which the densifying die member is moved away from the base member toward the second die section to reduce the volume of the die cavity after the first and second die sections are in their closed position and the die cavity is filled with an accurately controlled volume of molten metallic material.

DESCRIPTION OF THE PREFERRED EMBODIMENT

Figure 2:
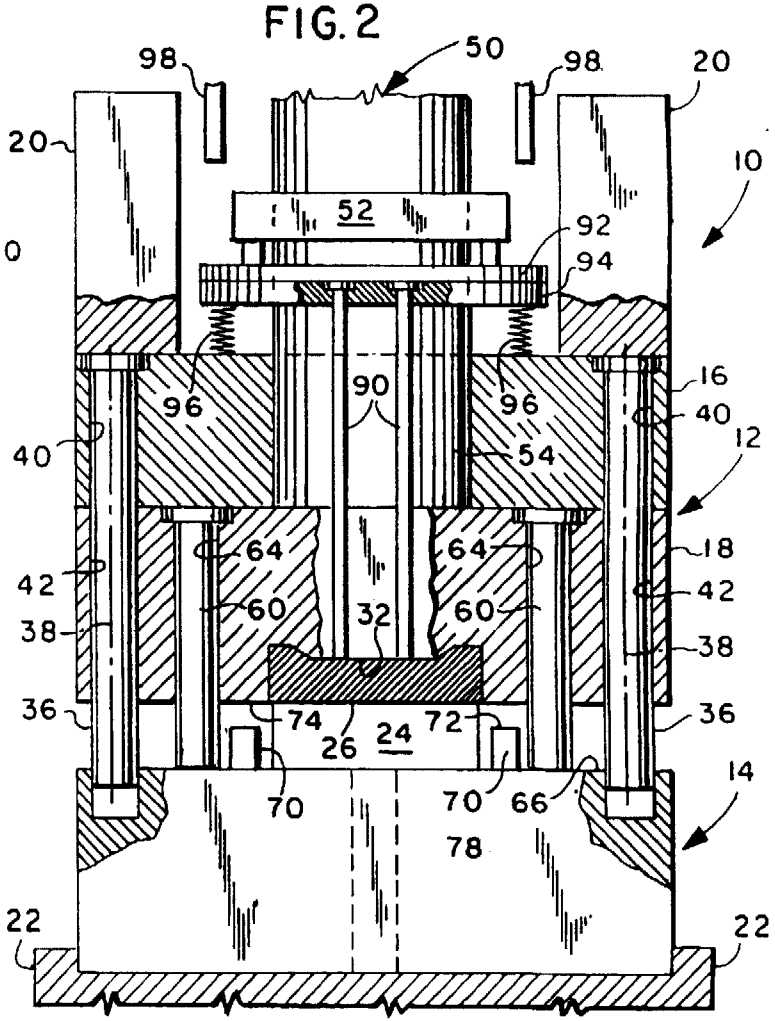
FIG. 2 is a fragmentary cross-sectional view similar to FIG. 1 illustrating the die assembly in its closed position wherein the die cavity is in its fill position in which the die cavity is adapted to receive an accurately controlled volume of molten metallic material therein which is controlled by the volume of the die cavity.

Referring to the Figures, and more particularly to FIGS. 1–4, a die assembly 10 is illustrated. The die assembly 10 includes a first die section 12 and a second die section 14. Die section 12 is a two-piece die section, including a base die member 16 and a densifying die member 18. Die section 12 is supported on a platten 20 of a squeeze casting machine, not illustrated. The squeeze casting machine may be similar to that disclosed in U.S. patent application Ser. No. 08/490,911, filed Jun. 16, 1995 and now abandoned, entitled *Pressurized Squeeze Casting Apparatus*, which is incorporated herein by reference. Platten 20 is in the preferred embodiment a movable platten which is fixed in a well known manner to the squeeze casting machine for movement therewith. The second die section 14 is rigidly secured to a platten 22 which, in the preferred embodiment, is a non-movable platten which also is a part of the squeeze casting machine, not illustrated. Platten 20 is operable to move toward and away from platten 22 in a well-known manner during operation of the squeeze casting machine. Movement of platten 20 effects movement of die section 12 from its open position illustrated in FIG. 1 in which the die section 14 is spaced apart from die section 12 to its closed position or fill position illustrated in FIG. 2 in which die assembly 14 is disposed contiguous to die section 12. While die section 12 will be described as being on a movable platten 20 and die section 14 will be described as being on a non-movable platten 22, it should be appreciated that either platten 20 or 22 could be non-movable and the other movable, or both plattens 20, 22 could move, while still coming within the scope of the present invention.

Die section 14 cooperates with die section 12 to define a die cavity 24 for casting an article 26 therein. Die cavity 24 is defined by a male die member 30 and a female die member 32. In the preferred embodiment, the female die member 32 is formed in a portion of the densifying die member 18 of the first die section 12 and the male die member 30 is formed as a portion of the second die section 14. It should be appreciated, however, that the male die member 30 could form a portion of the densifying member 18 while the female die member can be formed as a part of the second die section 14. While the male and female die members 30, 32 are illustrated as being integrally formed with the second die section 14 and the densifying member 18 of the first die section, the die members can be formed as separate pieces which are then secured to the densifying member 18 of the first die section and to the second die section 14 in a well-known manner.

The first die section 12 includes the base die member 16 which is rigidly fixed to platten 20 of the squeeze casting machine and the densifying die member 18. The base die member 16 includes a pair of substantially parallel plannar surfaces 15 and 17 and the densifying die member 18 includes a pair of substantially parallel plannar surfaces 19, 21. A plurality of elongate guide members 36, each of which includes a longitudinal axis 38, are rigidly supported by the base member 16 of the first die section 12. The base die member 16 includes a plurality of passageways 40 through which the guide members 36 extend and the densifying die member 18 includes a plurality of passageways 42 through which the guide members 36 extend. The passageways 40 and 42 are coaxial. In the preferred embodiment, the guide members 36 and the passageways 40, 42 have a cylindrical cross-sectional configuration, although other cross-sectional configurations could be utilized. While passageways 42 have been illustrated as being cylindrical, passageways 40, 42 could also be provided on the exterior surface of the densifying die member 18 and/or the base die member 16 as guideways which would cooperate with elongate guide members to provide for movement and support of the densifying die member 18.

Figure 1:
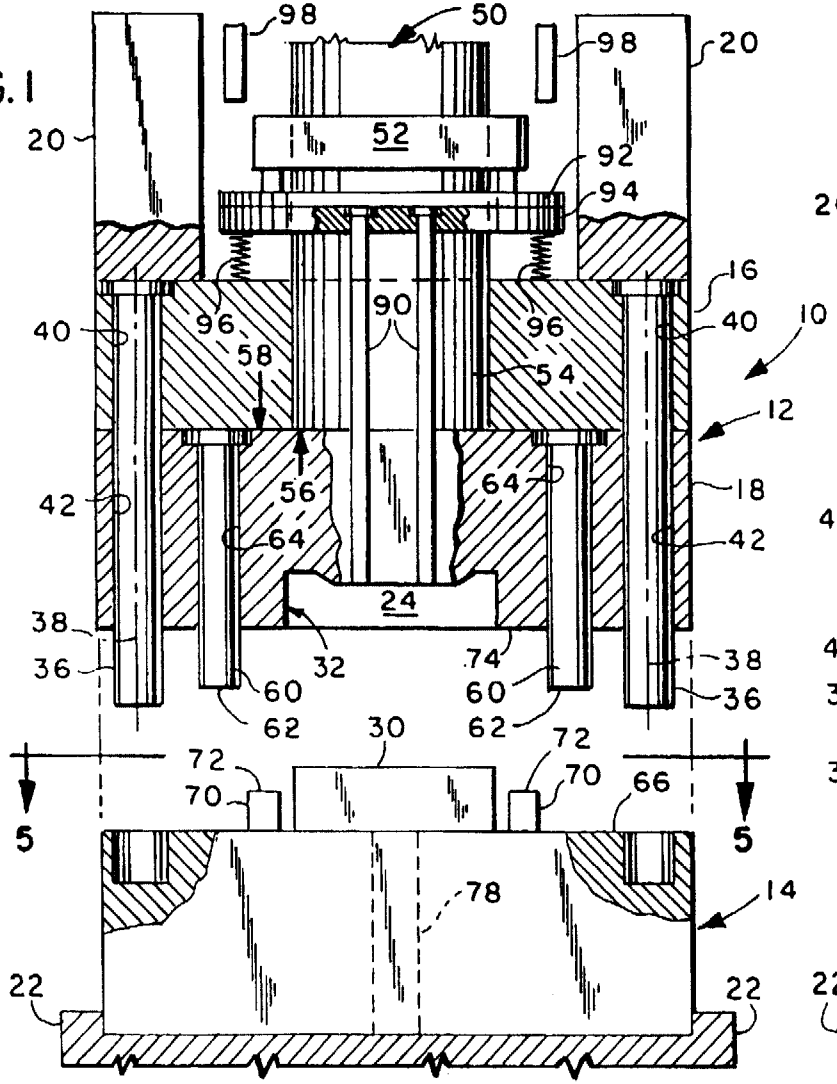
FIG. 1 is a fragmentary cross-sectional view taken approximately along lines 1—1 of FIG. 6 of a die assembly of the present invention for squeeze casting articles showing the die assembly in its open position supported on plattens of a squeeze casting machine.
Figure 3:
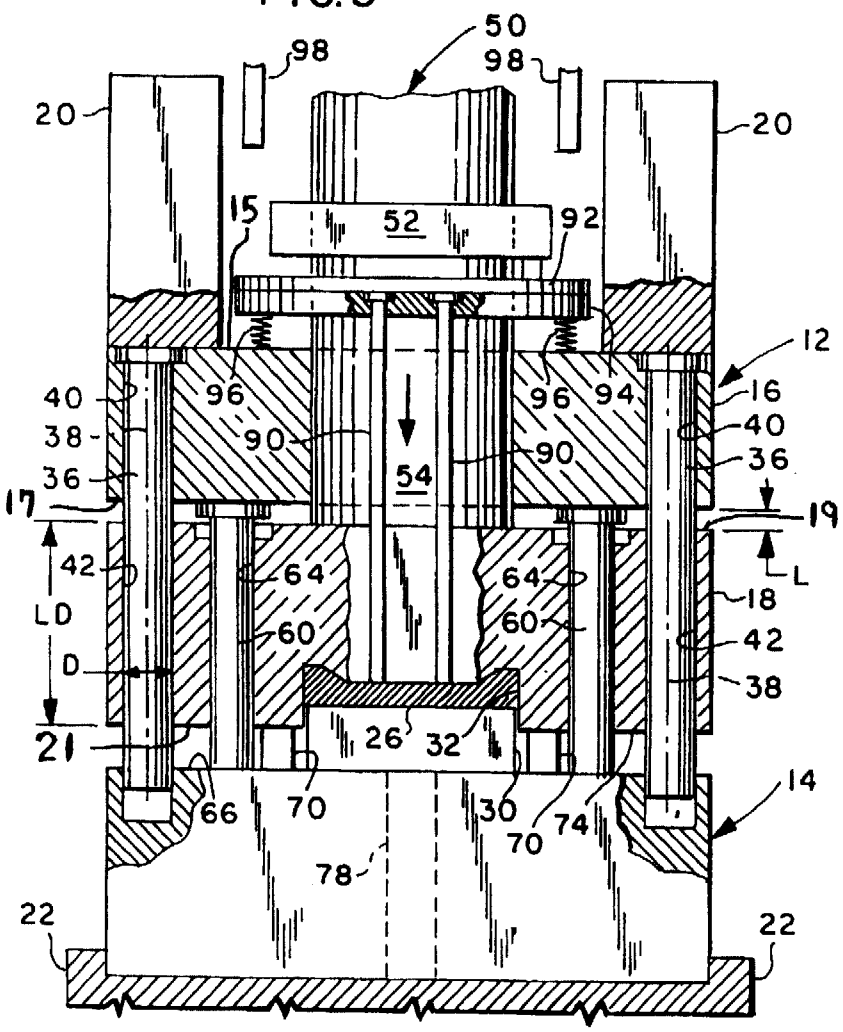
FIG. 3 is a fragmentary cross-sectional view similar to FIG. 2 illustrating the densifying die member of the first die section in its densifying position in which the densifying die member is spaced apart from the base die member of the first die section by the distance "L" and the molten metallic material in the die cavity is compressed.

The guide members 36 support the densifying die member 18 for movement in a direction parallel to the longitudinal axis 38 of the guide members 36 from its first position illustrated in FIGS. 1 and 2 in which the densifying die member 18 is disposed contiguous to the base die member 16 and plannar surface of 17 of base die member 16 is engaged with plannar surface 19 the densifying die member to its second or densifying position illustrated in FIG. 3 in which the plannar surface 19 of densifying die member 18 is spaced apart from the plannar surface 17 of base member 16 by the distance L. It should be noted that when the densifying die member 18 is moved to its densifying position, the base die member 16 is spaced apart from the densifying die member 18 and molten metal can not flow between the base and densifying die members. Such a construction results in a vast improvement over prior art structures wherein one die member slides within another die member and molten metal can interfere with such sliding movement.

The rigidity and precision positioning of the male and female die members 30, 32 relative to each other is paramount in order to provide for accuracy and repeatability of the squeeze casting operation. To this end, relatively tight tolerances are maintained between the guide members 36 and the passageways 42 in the densifying member 18. In the preferred embodiment, it is preferable that the diameter of the guide member 36 be equal to or greater than one-third of the length of the passageway 42 disposed in densifying member 18 to provide for precision linear movement of the densifying die member 18 along guide member 36. Thus, the length of the passageway 42 taken along the longitudinal axis 38, divided by the diameter of passageway 42 or the diameter of the guide member 36, should by equal to or greater than 3.

A hydraulic piston and cylinder assembly 50 is provided for effecting movement of the densifying die member 18 in a direction parallel to the longitudinal axis 38 of the guide members 36 from its position illustrated in FIG. 2 to its position illustrated in FIG. 3. The hydraulic piston and cylinder assembly 50 is powered by hydraulic fluid from the squeeze casting machine. The hydraulic piston and cylinder assembly 50 includes a main piston shown schematically at 52 and a cylinder 54 which is attached to the main piston 52 for movement therewith. Cylinder 54 includes an end surface 56 which is secured to a planar surface 58 of densifying die member 18 to effect movement of the densifying die member 18 relative to the base die member 16 in response to movement of the main piston 52.

A plurality of elongate stop members 60 are supported within passageways 64 in the densifying die member 18 for movement therewith. Each of the stop members 60 includes a stop surface 62 which is disposed substantially perpendicular to the longitudinal axis 38 of each of the guide members 36. Die section 14 includes a planar surface 66 disposed adjacent to the male die member 30 which is adapted to engage with the stop surface 62 on stop member 60 when die section 12 is moved toward die section 14 from its position illustrated in FIG. 1 to its position illustrated in FIG. 2 to accurately control the position of die section 12 relative to die section 14 when the die sections are in their closed position and the die cavity 24 is in its fill position. Thus, the position of female die member 32 and the male die member 30 are positively controlled to control the volume of die cavity 24 when die cavity 24 is in its fill position to thereby precisely control the volume of molten metallic material required to fill die cavity 24.

The stop members 60 are in the preferred embodiment cylindrical rods which are disposed within cylindrical passageways 64 located in the densifying die member 18. The stop members 60 in the preferred embodiment, do not support densifying die member 18 but serve only to accurately locate the stop surface 62 relative to the densifying die member 18. The tolerance maintained between the elongate stop member 60 and the passageways 64 disposed within the densifying member 18 is not critical. This is in contrast to the tighter tolerance maintained in the preferred embodiment between the passageways 42 and the elongate guide members 36 which support and guide densifying die member 18 for movement relative to the guide members 36. The tight tolerances maintained between the guide members 36 and the passageway 42 provide for accurate, reproducible movement of the densifying die member 18 relative to the base die member 16 and the die section 14. It should be appreciated, as will be more fully described hereinbelow, that the stop surfaces 62 could be formed on the guide members 36 and the stop members 60 could be eliminated without departing from the scope of the present invention. The stop members 60 can be shimmed to adjust the position of the stop surfaces 60 without removing the die assembly 10 from the squeeze casting machine to thereby facilitate set up and maintenance.

The die section 14 includes a plurality of stop members 70 having stop surfaces 72 which project from the planar surface 66 of die section 14. The stop surfaces 72 are operable to engage with the densifying die member 18 to accurately control the volume of die cavity 24 when the densifying die member 18 is in its densifying position, as is illustrated in FIG. 3, in which the volume of die cavity 24 is reduced from its fill position, illustrated in FIG. 2. The densifying die member 18 includes a planar surface 74 thereon which is adapted to engage with stop surfaces 72 of each of the stop members 70 when the densifying die member 18 is moved to its densifying position.

The die sections 12, 14 are readily replaceable due to the fact that all of the stop surfaces and stop members are located on die sections 12, 14. Thus, die sections 12, 14 can be easily removed from the plattens 20, 22 and new die sections can then be attached to the plattens to cast a different article without having to reset stop members in the squeeze casting machine since the new stop members will be included in the new die sections. Additionally, since the ejector mechanism is separate from the die assembly 10, as will be more fully described hereinafter, removal and replacement of the die assembly is facilitated.

A passageway 78 is preferably formed in the non-movable die section 14 for supplying the molten material to be cast into the die cavity 24. The passageway 78 is connected to a source of molten material which, in the preferred embodiment is preferably a molten metallic material such as aluminum, but could also include plastics such as high molecular weight plastic. When it is desired to fill die cavity 24, the die sections 12, 14 are moved to their closed position, as is illustrated in FIG. 2, and molten metallic material is introduced, preferably under low pressure, into the passageway 78.

Figure 5:
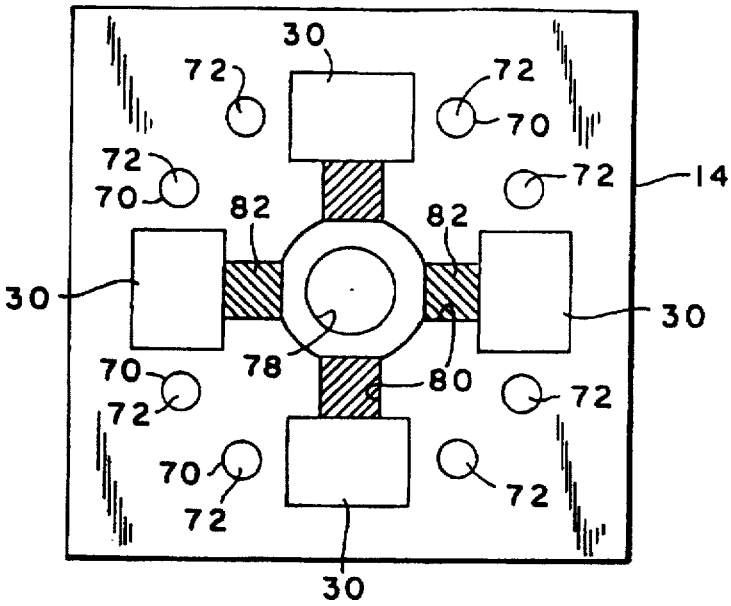
FIG. 5 is a cross-sectional view taken approximately along the lines 5—5 of FIG. 1 schematically illustrating the present invention utilized in a multiple die cavity die assembly and illustrating the male portion of the second die section.
Figure 6:
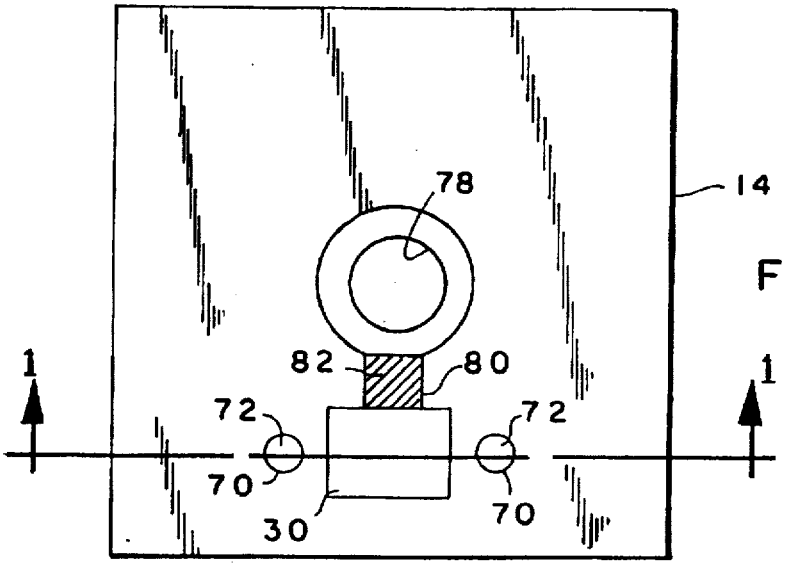
FIG. 6 is a view similar to FIG. 5 illustrating the present invention utilized in a single die cavity die assembly and illustrating the male portion of the second die section.

The passageway 78, as illustrated in FIGS. 5 and 6, is in fluid communication with the die cavities 24. FIG. 5 illustrates use of multiple die cavities in die section 14 and FIG. 6 illustrates a single cavity in die section 14 in which like reference numerals denote like parts. A runner 80 which is preferably formed at least in part in die section 14 connects each of the cavities 24 with the passageway 78 to provide for the flow of molten material into the die cavity 24. A shutoff pin, schematically illustrated at 82, can be provided for blocking runner 80 and sealing die cavity 24 after the cavity 24 has been filled with a predetermined volume of molten material. The shutoff pin 82 operates in a well-known manner to block runner 80 to prevent molten metallic material from escaping from the die cavity 24 after die cavity 24 is filled. Preferably, the shutoff pins 82 are each located contiguous to the die cavities 24 and the shutoff pin in part defines a surface of the article to be cast to thereby minimize or eliminate excess material, such as a runner, attached to cast article. The shutoff pin could be replaced with a gate which function in a similar manner to block runner 80 and seal die cavity 24 after the die cavity has been filled with a predetermined amount of molten material which is determined by the volume of die cavity 24. When the die cavity 24 is sealed by the shutoff pin 82 any molten material in passageway 78 and in runner 80 drains back to the source of molten metal, i.e. a furnace, to maximize the yields of the casting process by eliminating or minimizing excess material attached to the cast article, such as occurs when gate solidification occurs first and directional solidification of the molten material occurs from the gate outwardly. In the present apparatus, directional solidification is not relied upon. The shutoff pin is closed when the cavity 24 is filled and uniform pressure is applied to the molten material in cavity 24 to squeeze cast the article.

When it is desired to cast an article, the die sections 12 and 14 are moved from their open or spaced apart position illustrated in FIG. 1 to their closed or fill position, illustrated in FIG. 2, in which the first die section 12 is disposed contiguous to the second die section 14. While the die sections 12 and 14 are described as being contiguous to each other while in their closed position, as illustrated in FIG. 2, it should be appreciated that for all practical purposes, the die section 12 is in engagement with the die section 14 and the die cavity 24 is sealed by the interference fit between the male and female die members 30, 32. In this position, die section 12 moves toward die section 14 until the stop surfaces 62 on the elongate stop members 60 positively engage with the stop or planar surface 66 on the die section 14 to accurately locate die section 12 relative to die section 14 and to accurately control the volume of the die cavity 24 when the die cavity is in its fill position.

When the die sections 12 and 14 are in their closed position, as illustrated in FIG. 2, molten metallic material is introduced into the passageway 78 under low pressure. The molten metallic material passes through passageway 78, through runners 80, to fill the die cavities 24 with an accurately controlled volume of molten metallic material, which volume is controlled by accurately controlling the volume of cavity 24 by accurately controlling the position of the male and female die members 30, 32 and the die sections 12, 14 relative to each other. After the cavity 24 is filled with a predetermined volume of molten metallic material, the shutoff pin 82 closes runner 80 to seal the molten metallic material in die cavity 24.

When die cavity 24 is filled with molten metallic material, and runner 80 is sealed, piston 52, which is part of the squeeze casting machine, is energized to move cylinder 54 from its position illustrated in FIG. 2 to its position illustrated in FIG. 3. Simultaneously, any molten material in passageway 78 and runner 80 drains back through passageway 78 to the furnace (not illustrated) for reheating and reuse to maximize yields for the present apparatus. Advance of cylinder 54 causes movement of the densifying die member 18 along elongate guide members 36 toward die section 14 to reduce the volume of die cavity 24 and affect squeeze casting of the molten metallic material. Piston 52 and cylinder 54 advance until the stop surface 72 on stop member 70 engages with stop surface 74 disposed on the densifying die member 18. Engagement of stop surface 72 with stop surface 74 accurately controls the final squeeze or densifying position of the densifying die member 18 relative to die section 14 and male and female die members 30, 32 relative to each other to control the volume of die cavity 24 when the densifying die member 18 moves to its densifying position, as is illustrated in FIG. 3.

It should be realized that the entire female die member 32 is moved to densify the molten metallic material in die cavity 24. This effects a uniform densifying pressure on substantially the entire face of the article to be cast in contrast to prior art devices which pressurized the molten material at a localized location. Applying densifying pressure to substantially the entire face of the article to be cast provides superior metallurgic properties rather than if local densification pressure is utilized.

Figure 4:
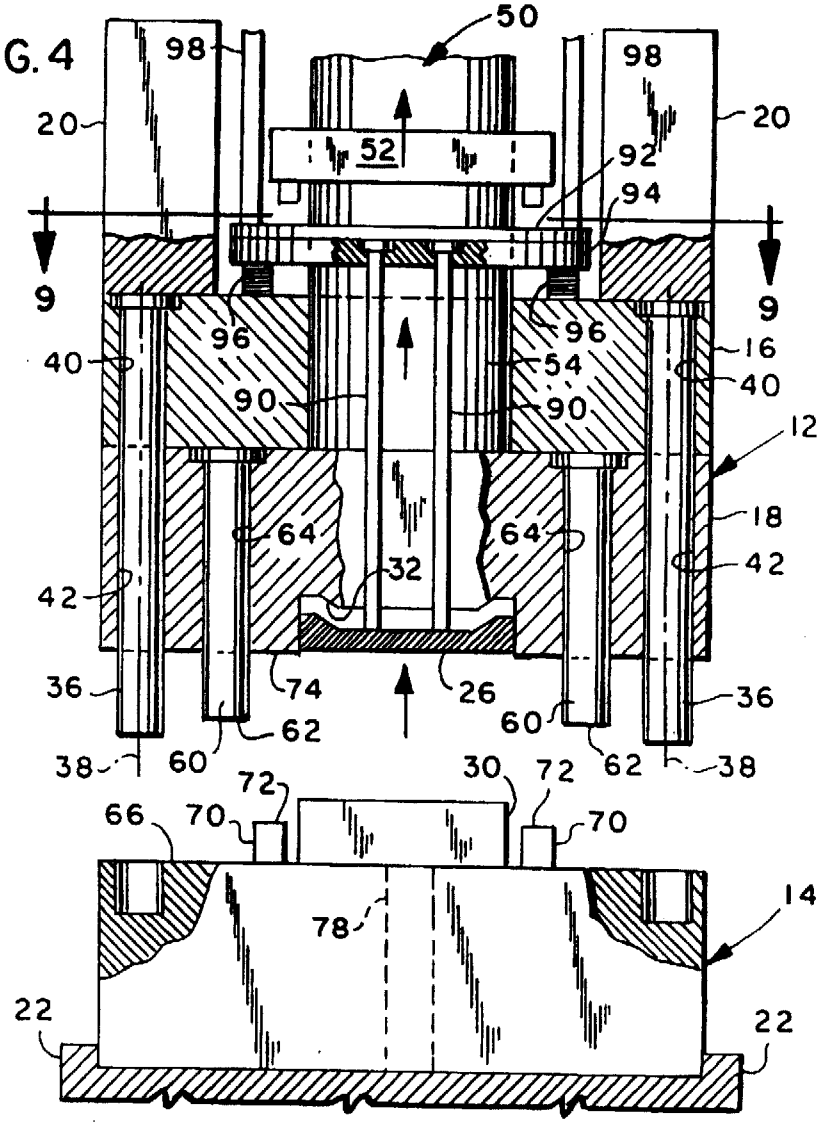
FIG. 4 is a fragmentary cross-sectional view similar to FIG. 3 illustrating the die assembly in its open position wherein an article which has been cast is ejected from the die cavity.

After the article 26 in cavity 24 solidifies, the die section 12 is moved to its open or spaced-apart position, as is illustrated in FIG. 4, and the article 26 is ejected from the female die section 32 by a pair of ejector pins 90. When it is desired to eject an article 26, piston and cylinder assembly 50 retract densifying die member 18 to its position illustrated in FIG. 4 wherein the densifying die member 18 is moved a distance "L" to engage with base die member 16. Die section 12 is then moved to its open position as is illustrated in FIG. 4 by moving platten 20 of the squeeze casting machine.

Figure 9:
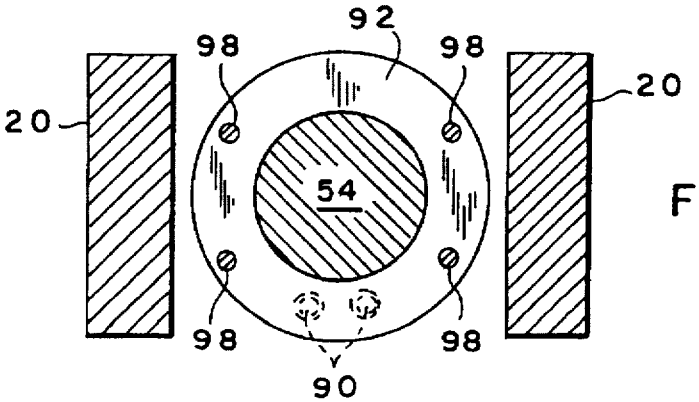
FIG. 9 is a cross-sectional view taken approximately along the lines 9—9 of FIG. 4 more fully illustrating the ejector mechanism and the cylinder for moving the densifying die member relative to the base die member of the first die section.

Ejector pins 90 are connected to an ejector plate 92 and a return plate 94. A plurality of springs 96 bias return plate 94 to bias ejector pins 90 to their retracted position, as is illustrated in FIG. 3. In one embodiment of the invention, when the die sections 12 and 14 are moved to their spaced apart positions illustrated in FIG. 4, an ejector cylinder, which is part of the squeeze casting machine, not illustrated, is energized to move a plurality of core pins 98 from their position illustrated in FIG. 3 to their position illustrated in FIG. 4 in which the core pins 98 engage with ejector plate 92 to move ejector pins 90 against the bias of springs 96 to their ejecting position illustrated in FIG. 4 in which the ejector pins eject a cast article 26 from the male die cavity 32. In another embodiment of the invention, the core pins 98 are fixed by the squeeze casting machine and are operable to engage with the ejector plate 92 to effect movement of the ejector pins 90 to their position illustrated in FIG. 4 when the platten 20 of the squeeze casting machine moves the die section 12 to its position illustrated in FIG. 4. Movement of the die section 12 in an upwardly direction, as viewed in FIG. 4, effects engagement of the fixed core pins 98 with the ejector plate 92 to eject an article 26 from the female die member 32. After the article is rejected, the platten 20 is then moved in a downwardly direction and the springs 96 acting on return plate 94 retract ejector pins 90 to their position illustrated in FIG. 1. It should be appreciated, as is viewed in FIG. 9, that the cylinder assembly 54 is surrounded by the ejector plate 92 which forms a collar around cylinder 54 to provide for relative movement between the cylinder 54 and the ejector plate 92. The ejector plate 92, core pins 98 and return springs 96 are all part of the squeeze casting machine and need not be removed or adjusted when the die assembly 10 is replaced to thereby facilitate die replacement and maintenance.

Figure 8:
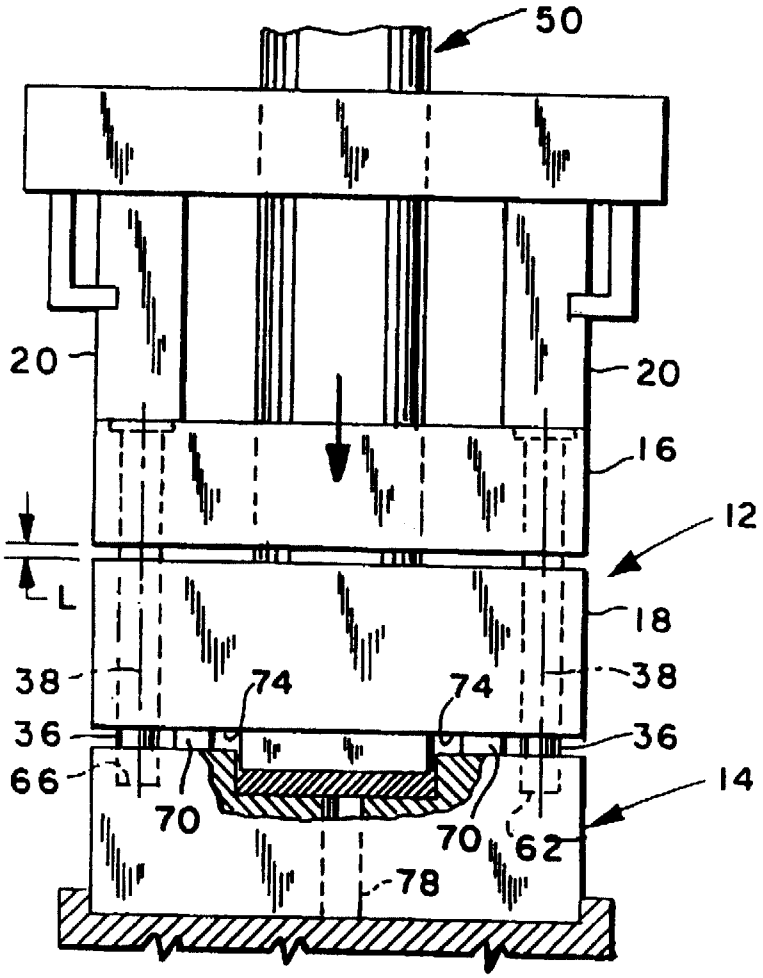
FIG. 8 is a fragmentary cross-sectional view similar to FIG. 7 illustrating the die assembly of FIG. 7 in its densifying position in which the densifying die member is spaced apart from the base die member of the first die section and the volume of the die cavity has been reduced an accurately controlled amount to squeeze cast an article.
Figure 7:
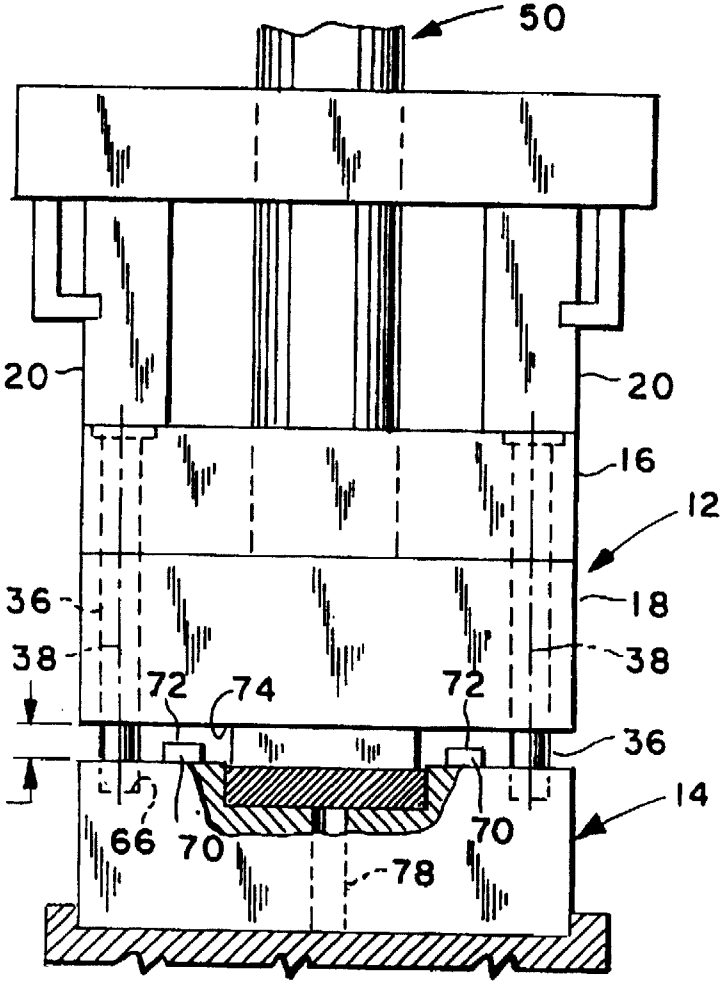
FIG. 7 is a fragmentary cross-sectional view of a further embodiment of the present invention illustrating the die assembly in its closed position and the die cavity in its fill position in which the die cavity is adapted to receive molten metallic material therein.

An alternative embodiment of the present invention is disclosed in FIGS. 7 and 8 wherein similar parts will be identified with the same number as in preceding figures. The alternative embodiment disclosed in FIGS. 7 and 8 eliminates the use of the stop members 60 by combining the stop surfaces 62 with the elongate guide members 36. The die sections 12 and 14 can be moved to their closed or fill position, as is illustrated in FIG. 7. In this position, the stop surfaces 62 disposed on the end of the elongate guide member 36 engages with a stop surface 66 disposed on the die section 14. Engagement of the stop surfaces 62 and 66 positively controls the volume of the die cavity 24 when the die sections 12, 14 are in their fill or closed position. After the die cavity 24 is filled with a molten metallic material and the runner 80 is sealed, the hydraulic cylinder and piston assembly 50 is actuated to move the densifying die member 18 from its position illustrated in FIG. 7 to its position illustrated in FIG. 8, and move the densifying die member 18 toward the die section 14 and away from base die member 16 until stop surface 72 engages with stop surface 74 on the densifying die member 18. Movement of the densifying die member 18 to its densifying position illustrated in FIG. 8 reduces the volume of die cavity 24 to squeeze cast an article 26 therein. The die sections 12 and 14 can then be opened and the article ejected from cavity 24, as has been heretofore described.

From the foregoing, it should be apparent that a new and improved die assembly 10 for squeeze casting an article 26 from a molten metallic material, including a two-piece first die section 12 and a second die section 14 has been disclosed. The two-piece first die section includes a densifying die member 18 and a base die member 16. The first and second die sections cooperate to form a die cavity 24 therebetween having the shape of an article to be cast. The first and second die sections 12, 14 are movable between an open position illustrated in FIG. 1 in which the first die section 12 is spaced apart from the second die section 14 to a closed position illustrated in FIG. 2 in which the first and second die sections 12, 14 are disposed contiguous to each other to define a fill position for the die cavity 24 wherein the die cavity can be filled with an accurately controlled volume of molten metallic material. A plurality of elongate guide members 36 extend from the base die member 16 toward the second die section 14, and the densifying die member 18 includes a plurality of openings 42, each of which is adapted to receive one of the guide members 36 therein for supporting the densifying die member 18 for movement relative to the base die member 16 from a first position in which the densifying die member is disposed contiguous to the second die section to define the fill position for the die cavity, as is illustrated in FIG. 2, to a densifying position in which the densifying die member 18 is moved away from the base die member 16 and toward the second die section 14 to reduce the volume of the die cavity 24, as is illustrated in FIG. 3.

What we claim is:

1. A die assembly for squeeze casting an article from a molten material, comprising a two-piece first die section, including a densifying die member and a base die member, and a second die section, said first die section adapted to be rigidly secured to a first platten of a squeeze casting machine, said second die section being adapted to be rigidly secured to a second platten of a squeeze casting machine, said first and second die sections cooperating to define a die cavity having the shape of an article to be cast, said first die section and first platten being movable relative to said second die section and said second platten between an open position in which said first die section is spaced apart from said second die section and a closed position in which said first die section is disposed contiguous to said second die section to define a fill position for said die cavity wherein said die cavity can be filled with an accurately controlled volume of molten material to cast an article, said densifying die member of said first die section cooperating with said second die section to define said die cavity, said densifying die member being movable relative to said base die member from a first position to a densifying position in which said densifying die member is spaced apart from said base die member, said densifying die member when moving to said densifying position moving toward said second die section to reduce by an accurately controlled predetermined amount the volume of said die cavity when said first and second die sections are in their closed position and said die cavity is filled with molten material.

2. A die assembly as defined in claim 1 further including a stop surface disposed on said second die section for engaging with said densifying die member of said first die section to accurately locate said second die section relative to said densifying die member when said densifying die member moves to said densifying position to accurate control the volume of said die cavity.

3. A die assembly as defined in claim 1 further including a plurality of guide members for supporting said densifying die member for movement relative to said base die member, each of said guide members including a stop surface thereon, said second die section including an initial stop surface for engaging with said stop surface on said guide members when said first and second die sections are in said closed position to accurately locate said second die section relative to said densifying die member to accurately control the volume of said die cavity when said die cavity is initially filled with molten material.

4. A die assembly as defined in claim 3 further including a stop surface disposed on said second die section for engaging with said densifying die member of said first die section to accurately locate said second die section relative to said densifying die member when said densifying die member moves to said densifying position to accurate control the volume of said cavity.

5. A die assembly as defined in claim 3 wherein each of said plurality of elongate guide members are supported by said base die member and comprises a cylindrical rod, each of which has a longitudinal axis, said densifying die member including a plurality of cylindrical passageways therein, each of which includes a longitudinal axis and each of which receives one of said cylindrical rods therein with the longitudinal axis of said cylindrical rod and said cylindrical passageway being coaxial, said plurality of cylindrical rods supporting said densifying die member for movement in a direction parallel to the longitudinal axis of said cylindrical rods relative to said base die member between said first position in which said densifying die member is in engagement with said base die member and said densifying position in which said densifying member die member is spaced apart from said base die member.

6. A die assembly as defined in claim 5 wherein each of said cylindrical rods includes an end surface thereon disposed substantially perpendicular to said longitudinal axis of said cylindrical rod which defines said stop surface on said guide member, said stop surface on said cylindrical rod engaging with said initial stop surface on said second die section when said die cavity is in said fill position to accurately control the volume of said die cavity prior to said densifying die member moving to said densifying position.

7. A die assembly as defined in claim 1, further including a plurality of guide members for supporting said densifying die member for movement relative to said base die member toward said second die section, said densifying die member when in said first position being in engagement with said base die member and when in said densifying position being movable along said guide members to a position in which said densifying die member is spaced apart from said base die member.

8. A die assembly as defined in claim 1, wherein said first die section is adapted to be rigidly secured to a movable platten of a squeeze casting machine and said second die section is adapted to be rigidly secured to a fixed platten of a squeeze casting machine, said first die section being movable toward and away from said second die section between said open and closed positions.

9. A die assembly as defined in claim 7, further including a stop member movable with said first die section and a stop surface on said second die section for engaging with said stop member to accurately locate said first die section relative to said second die section when said die sections are in said closed position to accurately control the volume of said die cavity when said die sections are in said closed position.

10. A die assembly for squeeze casting an article from a molten material comprising a two-piece first die section including a densifying die member and a base die member, and a second die section, said first and second die sections cooperating to form a die cavity therebetween having the shape of an article to be cast, said first and second die sections being movable between an open position in which said first die section is spaced apart from said second die section, and a closed position in which said first and second die sections are disposed contiguous to each other to define a fill position for said die cavity wherein said die cavity can be filled with an accurately controlled volume of molten material to cast an article, a plurality of elongate guide members extending from said base die member toward said second die section, said densifying die member having a plurality of openings, each of which is adapted to receive one of said guide members therein for supporting said densifying die member for movement relative to said base die member from a first position in which said densifying die member is disposed contiguous to said second die section to define said fill position for said die cavity, to a densifying position in which said densifying die member is moved away from said base die member and toward said second die section, to reduce the volume of said die cavity after said first and second die sections are in their closed position and said die cavity is filled with an accurately controlled volume of molten material, each of said elongate guide members including a longitudinal axis, said densifying die member being movable in a direction parallel to said longitudinal axis of said guide members when said densifying die member moves from said first to said densifying position.

11. A die assembly as defined in claim 10 wherein said second die section includes a stop surface and each of said plurality of guide members includes a stop surface thereon disposed substantially perpendicular to said longitudinal axis of said guide members for engaging with said stop surface on said second die section to accurately locate said second die section relative to said first die section when said first and second die sections are in their closed position to accurately control the volume of said die cavity when said first and second die sections are in said fill position.

12. A die assembly for squeeze casting an article as defined in claim 10, further including a stop surface disposed on said second die section for engaging with said densifying die member of said first die section to accurate locate said second die section relative to said densifying die member when said densifying die member moves to said densifying position to reduce the volume of said die cavity and accurately control the volume of said die cavity when said densifying die member moves to said densifying position.

13. A die assembly for squeeze casting an article as defined in claim 12, further including a plurality of elongate stop members supported by said base die member and extending therefrom in a direction substantially parallel to said longitudinal axis of said elongate guide members, one of said plurality of base stop surfaces being located on each of said elongate stop members for engaging with said second die section when said first and second die sections are in their closed position to accurately locate said densifying die member relative to said second die section when said die cavity is in said fill position.

14. A die assembly for squeeze casting an article as defined in claim 13, wherein said densifying die member includes a plurality of passageways therein disposed substantially parallel to the longitudinal axis of said elongate guide members, each of said passageways receiving one of said plurality of elongate guide members therein, said densifying die member being movable relative to said guide members in a direction parallel to the longitudinal axis of said guide members.

15. A die assembly for squeeze casting an article as defined in claim 10, further including a plurality of base stop surfaces supported at least in part by said base die member, each of said plurality of base stop surfaces being disposed substantially perpendicular to the longitudinal axis of said elongate guide members and being engagable with said second die section when said first and second die sections move to their closed position, said base stop surface accurately positioning said densifying die member relative to said second die section to accurately control the volume of said cavity when said first and second die sections are in their closed position and said die cavity is in said fill position.

16. A die assembly for squeeze casting an article as defined in claim 15, wherein said base stop surfaces are disposed on said elongate guide members for engaging with said second die section.

17. A die assembly for squeeze casting an article as defined in claim 10 wherein said densifying die member moves to said densifying position to compress the molten material in said die cavity across substantially the entire article to be cast.

18. A die assembly for squeeze casting an article from a molten material, comprising a two-piece first die section, including a densifying die member and a base die member, and a second die section, said first die section adapted to be rigidly secured to a first platten of a squeeze casting machine, said base die member including a pair of substantially parallel plannar surfaces one of which is engagable with the platten of the squeeze casting machine when said first die section is secured to the platten and the other of which is engagable with said densifying die member, said densifying die member including a pair of substantially parallel planner surfaces one of which is engagable with said other planner surface of said base die member and the other of which is engagable with said second die section, said second die section being adapted to be rigidly secured to a second platten of a squeeze casting machine, said first and second die sections cooperating to define a die cavity having the shape of an article to be cast, said first die section and first platten being movable relative to said second die section and said second platten between an open position in which said first die section is spaced apart from said second die section and a closed position in which said first die section is disposed contiguous to said second die section to define a fill position for said die cavity wherein said die cavity can be filled with an accurately controlled volume of molten material to cast an article, said other plannar surface of said densifying die member of said first die section cooperating with said second die section to define said die cavity, said densifying die member being movable relative to said base die member from a first position in which said other planner surface of said base die member is engaged with said one plannar surface of said densifying die member to a densifying position in which one said plannar surface of said densifying die member is spaced apart from said other plannar surface of said base die member, said densifying die member when moving to said densifying position moving toward said second die section to reduce by an accurately controlled predetermined amount the volume of said die cavity when said first and second die sections are in their closed position and said die cavity is filled with molten material.

19. A die assembly as defined in claim 18 further including a stop surface disposed on said second die section for engaging with said other plannar surface of said densifying die member of said first die section to accurately locate said second die section relative to said densifying die member when said densifying die member moves to said densifying position to accurate control the volume of said die cavity.

20. A die assembly as defined in claim 18 further including a plurality of guide member for supporting said densifying die member for movement relative to said base die member, each of said guide members including a stop surface thereon, said second die section including an initial stop surface for engaging with said stop surface on said guide members when said first and second die sections are in said closed position to accurately locate said second die section relative to said densifying die member to accurately control the volume of said die cavity when said die cavity is initially filled with molten material.

21. A die assembly as defined in claim 20 further including a stop surface disposed on said second die section for engaging with said other plannar surface of said densifying die member of said first die section to accurately locate said second die section relative to said densifying die member when said densifying die member moves to said densifying position to accurate control the volume of said cavity.

22. A die assembly as defined in claim 20 wherein each of said plurality of elongate guide members are supported by said base die member and comprises a cylindrical rod, each of which has a longitudinal axis, said densifying die member including a plurality of cylindrical passageways therein, each of which includes a longitudinal axis and each of which receives one of said cylindrical rods therein with the longitudinal axis of said cylindrical rod and said cylindrical passageway being coaxial, said plurality of cylindrical rods supporting said densifying die member for movement in a direction parallel to the longitudinal axis of said cylindrical rods relative to said base die member between said first position in which said densifying die member is in engagement with said base die member and said densifying position in which said densifying member die member is spaced apart from said base die member.

23. A die assembly as defined in claim 22 wherein each of said cylindrical rods includes an end surface thereon disposed substantially perpendicular to said longitudinal axis of said cylindrical rod which defines said stop surface on said guide member, said stop surface on said cylindrical rod engaging with said initial stop surface on said second die section when said die cavity is in said fill position to accurately control the volume of said die cavity prior to said densifying die member moving to said densifying position.

24. A die assembly as defined in claim 18, further including a plurality of guide members for supporting said densifying die member for movement relative to said base die member toward said second die section, said one plannar surface of said densifying die member when in said first position being in engagement with said other plannar surface of said base die member and when in said densifying position being movable along said guide members to a position in which said one plannar surface of said densifying die member is spaced apart from said other plannar surface of said base die member.

25. A die assembly as defined in claim 24, further including a stop member movable with said first die section and a stop surface on said second die section for engaging with said stop member to accurately locate said first die section relative to said second die section when said die sections are in said closed position to accurately control the volume of said die cavity when said die sections are in said closed position.

* * * * *